US010833418B2

(12) United States Patent
Cheng

(10) Patent No.: US 10,833,418 B2
(45) Date of Patent: Nov. 10, 2020

(54) ANTENNA STRUCTURE

(71) Applicant: Wistron NeWeb Corp., Hsinchu (TW)

(72) Inventor: Chia-Shang Cheng, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/426,221

(22) Filed: May 30, 2019

(65) Prior Publication Data

US 2020/0287288 A1 Sep. 10, 2020

(30) Foreign Application Priority Data

Mar. 7, 2019 (TW) ..... 108107545 A

(51) Int. Cl.

| | |
|---|---|
| ***H01Q 1/36*** | (2006.01) |
| ***H01Q 9/28*** | (2006.01) |
| ***H01Q 19/10*** | (2006.01) |
| ***H01Q 9/18*** | (2006.01) |
| ***H01Q 1/24*** | (2006.01) |
| ***H01Q 1/48*** | (2006.01) |
| ***H01Q 1/38*** | (2006.01) |

(52) U.S. Cl.

CPC ..... *H01Q 9/18* (2013.01); *H01Q 1/243* (2013.01); *H01Q 1/36* (2013.01); *H01Q 1/38* (2013.01); *H01Q 1/48* (2013.01); *H01Q 9/28* (2013.01); *H01Q 19/108* (2013.01)

(58) Field of Classification Search

CPC ..... H01Q 9/285; H01Q 1/243; H01Q 19/108; H01Q 1/38; H01Q 15/14; H01Q 19/10; H01Q 5/378; H01Q 5/385; H01Q 9/065; H01Q 9/16; H01Q 19/005; H01Q 1/241; H01Q 5/321; H01Q 5/48

See application file for complete search history.

(56) References Cited

U.S. PATENT DOCUMENTS

| | | | | |
|---|---|---|---|---|
| 6,515,634 | B2 * | 2/2003 | Desclos | H01Q 3/12 343/815 |
| 7,501,992 | B2 * | 3/2009 | Yamagajo | H01Q 21/24 343/795 |
| 8,427,337 | B2 * | 4/2013 | Wilbur | H01Q 9/285 340/870.02 |
| 8,717,245 | B1 * | 5/2014 | Krivokapic | H01Q 5/378 343/795 |
| 8,952,858 | B2 * | 2/2015 | de Rochemont | H01Q 9/26 343/803 |
| 9,257,741 | B2 * | 2/2016 | Cheng | H01Q 1/36 |
| 10,164,339 | B1 * | 12/2018 | Hsu | H01Q 15/14 |

(Continued)

FOREIGN PATENT DOCUMENTS

| | | | |
|---|---|---|---|
| JP | 2007251241 A | * | 9/2007 |
| TW | I255584 B | | 5/2006 |
| TW | I256752 B | | 6/2006 |

*Primary Examiner* — Vibol Tan

(74) *Attorney, Agent, or Firm* — McClure, Qualey & Rodack, LLP

(57) ABSTRACT

An antenna structure includes a dipole antenna element and a floating metal element. The floating metal element is disposed adjacent to the dipole antenna element. The vertical projection of the dipole antenna element at least partially overlaps the floating metal element. The floating metal element is configured for fine-tuning the radiation pattern of the antenna structure and to increase the operation bandwidth of the antenna structure.

18 Claims, 11 Drawing Sheets

(56) References Cited

U.S. PATENT DOCUMENTS

| | | | | |
|---|---|---|---|---|
| 10,312,589 | B2 * | 6/2019 | Sayama | H01Q 1/243 |
| 10,381,726 | B1 * | 8/2019 | Yeh | H01Q 9/0407 |
| 10,424,831 | B2 * | 9/2019 | Hsu | H01Q 1/246 |
| 10,431,875 | B2 * | 10/2019 | Chang | H01Q 9/0442 |
| 10,587,051 | B2 * | 3/2020 | Hsu | H01Q 5/385 |
| 2011/0043424 | A1 * | 2/2011 | Lee | H01Q 9/285<br>343/816 |
| 2015/0061952 | A1 * | 3/2015 | Chiang | H01Q 5/371<br>343/749 |

* cited by examiner

ANTENNA STRUCTURE

CROSS REFERENCE TO RELATED APPLICATIONS

This application claims priority of Taiwan Patent Application No. 108107545 filed on Mar. 7, 2019, the entirety of which is incorporated by reference herein.

BACKGROUND OF THE INVENTION

Field of the Invention

The disclosure generally relates to an antenna structure, and more particularly, it relates to a wideband antenna structure that includes a floating metal element.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, this can degrade the communication quality of the relative mobile device. Accordingly, it has become a critical challenge for antenna designers to design a small-size, wideband antenna element.

BRIEF SUMMARY OF THE INVENTION

In an exemplary embodiment, the disclosure is directed to an antenna structure which includes a dipole antenna element and a floating metal element. The floating metal element is disposed adjacent to the dipole antenna element. The vertical projection of the dipole antenna element at least partially overlaps the floating metal element.

In some embodiments, the antenna structure at least covers an operation frequency band from 2400 MHz to 2500 MHz.

In some embodiments, the dipole antenna element includes a first radiation element coupled to a positive feeding point, and a second radiation element coupled to a negative feeding point.

In some embodiments, the first radiation element and the second radiation element are disposed on the same plane.

In some embodiments, the first radiation element and the second radiation element are respectively disposed on different planes.

In some embodiments, the first radiation element further includes a first terminal bending portion, and the second radiation element further includes a second terminal bending portion.

In some embodiments, each of the first radiation element and the second radiation element substantially has a straight-line shape or an L-shape.

In some embodiments, the floating metal element substantially has a U-shape.

In some embodiments, the floating metal element substantially has an arc-shape.

In some embodiments, the floating metal element includes a main portion, a first coupling portion, and a second coupling portion. The main portion is coupled between the first coupling portion and the second coupling portion.

In some embodiments, the floating metal element further includes a first terminal widening portion coupled to the first coupling portion.

In some embodiments, the floating metal element further includes a second terminal widening portion coupled to the second coupling portion.

In some embodiments, the distance between the main portion of the floating metal element and the vertical projection of the dipole antenna element is longer than or equal to 1/40 wavelength of the operation frequency band.

In some embodiments, the distance between the main portion of the floating metal element and the vertical projection of the dipole antenna element is shorter than or equal to 1/24 wavelength of the operation frequency band.

In some embodiments, the length of the main portion of the floating metal element is from 9/40 wavelength to 4/15 wavelength of the operation frequency band.

In some embodiments, the first coupling portion and the second coupling portion of the floating metal element each have a length that is longer than 1/30 wavelength of the operation frequency band.

In some embodiments, the distance between the dipole antenna element and the floating metal element is longer than or equal to 0.2 mm.

In some embodiments, the antenna structure further includes a dielectric substrate. The dipole antenna element and the floating metal element are respectively disposed on different planes of the dielectric substrate.

In some embodiments, the dielectric substrate is a two-layer PCB (Printed Circuit Board) or a six-layer PCB.

In some embodiments, the antenna structure further includes a ground plane disposed on the dielectric substrate. The ground plane has a clearance region. The vertical projection of the dipole antenna element and the vertical projection of the floating metal element are both inside the clearance region.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
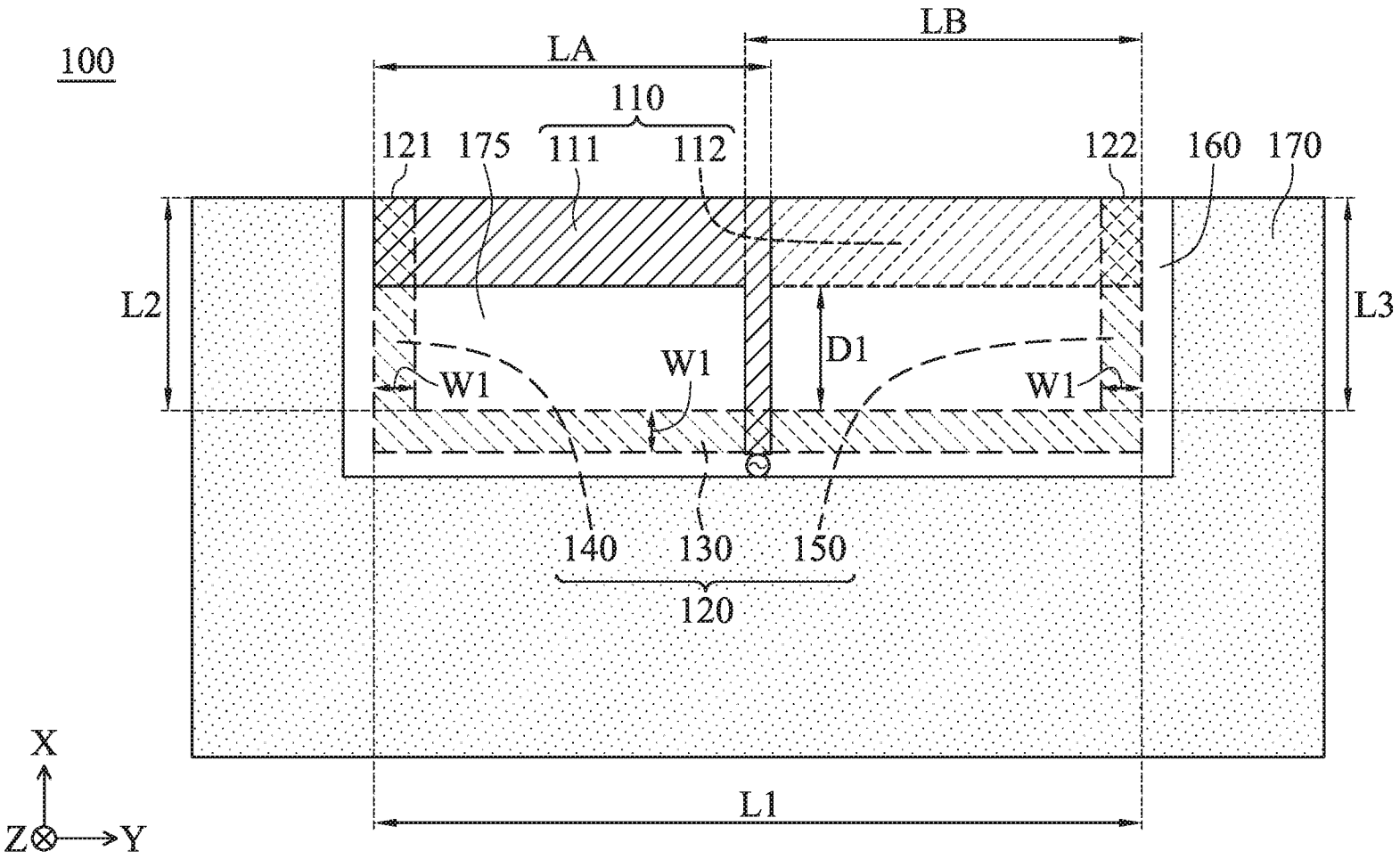
FIG. 1A is a top view of an antenna structure according to an embodiment of the invention.
Figure 1B:
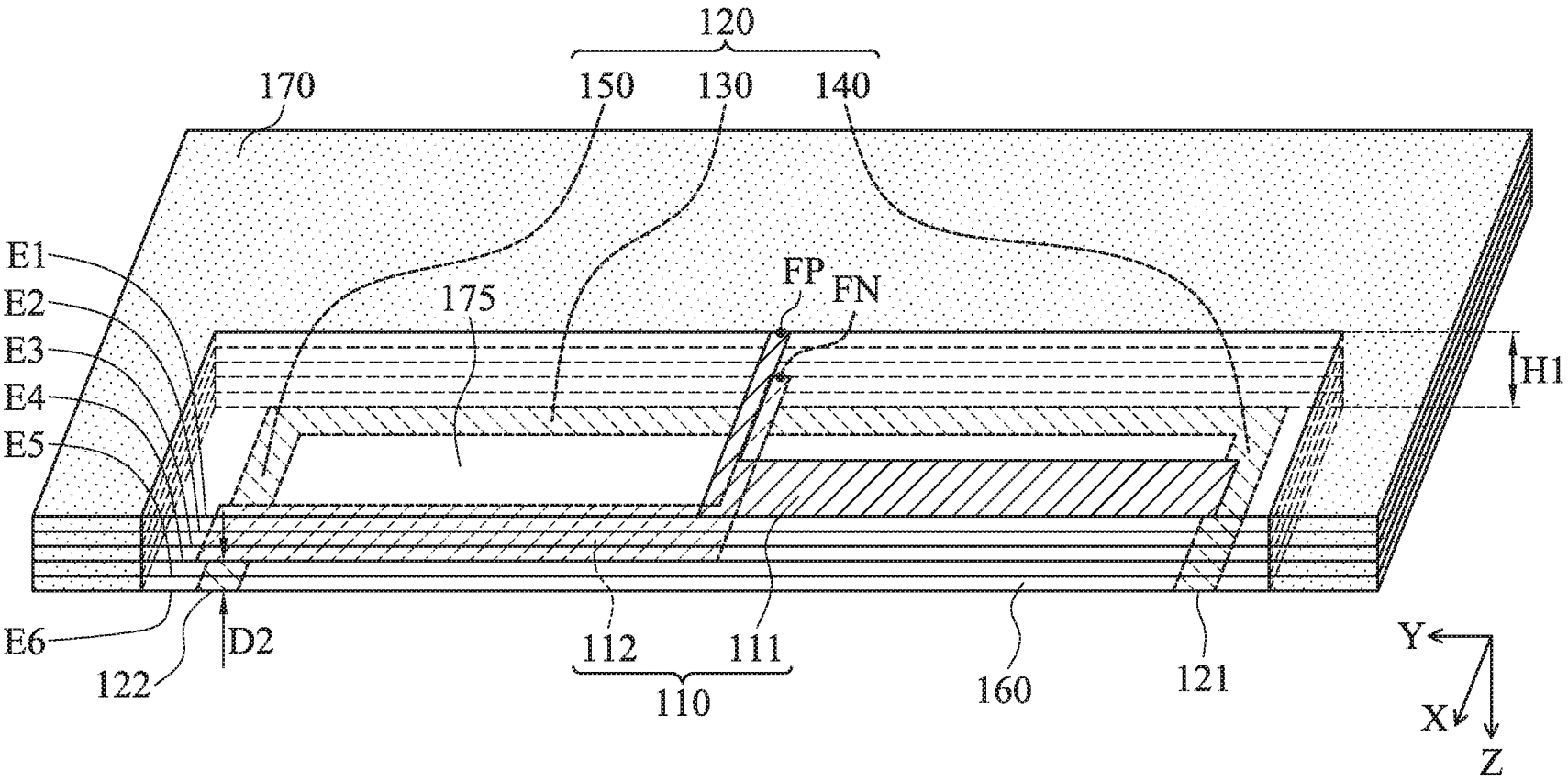
FIG. 1B is a perspective view of an antenna structure according to an embodiment of the invention.

FIG. 1A is a top view of an antenna structure 100 according to an embodiment of the invention. FIG. 1B is a perspective view of the antenna structure 100 according to an embodiment of the invention. Please refer to FIG. 1A and FIG. 1B together. The antenna structure 100 may be applied in a communication device, such as a wireless access point, a smart phone, a tablet computer, or a notebook computer, but it is not limited thereto. In the embodiment of FIG. 1A and FIG. 1B, the antenna structure 100 at least includes a dipole antenna element 110 and a floating metal element 120. The floating metal element 120 is adjacent to the dipole antenna element 110, and the floating metal element 120 is completely separate from the dipole antenna element 110. It should be noted that the term "adjacent" or "close" over the disclosure means that the distance (spacing) between two corresponding elements is smaller than a predetermined distance (e.g., 5 mm or shorter).

The dipole antenna element 110 may be made of a conductive material, such as a metal material. The detailed shape of the dipole antenna element 110 is not limited in the invention. Specifically, the dipole antenna element 110 includes a first radiation element 111 and a second radiation element 112. The first radiation element 111 is coupled to a positive feeding point FP. The second radiation element 112 is coupled to a negative feeding point FN. Each of the first radiation element 111 and the second radiation element 112 may substantially have a straight-line shape. The positive feeding point FP and the negative feeding point FN may be coupled to a positive electrode and a negative electrode of a signal source, respectively (not shown). For example, the aforementioned signal source may be an RF (Radio Frequency) module for exciting the antenna structure 100. There is a coupling effect induced between the dipole antenna element 110 and the floating metal element 120, so that the floating metal element 120 may be configured to improve the radiation performance of the dipole antenna element 110. In order to enhance the aforementioned coupling effect, the vertical projection of the dipole antenna element 110 should at least partially overlap the floating metal element 120. That is, if the floating metal element 120 is disposed on a specific plane, the first radiation element 111 and/or the second radiation element 112 may have a vertical projection on the specific plane, and the vertical projection may at least partially overlap the floating metal element 120.

The floating metal element 120 may substantially have a U-shape. The floating metal element 120 has a first end 121 and a second end 122, which are two open ends. Specifically, the floating metal element 120 includes a main portion 130, a first coupling portion 140, and a second coupling portion 150. The main portion 130 is coupled between the first coupling portion 140 and the second coupling portion 150. Each of the main portion 130, the first coupling portion 140, and the second coupling portion 150 may substantially have a straight-line shape. The main portion 130 may be substantially parallel to the dipole antenna element 110. The first coupling portion 140 and the second coupling portion 150 may both be substantially perpendicular to the main portion 130. In the floating metal element 120, the length L1 of the main portion 130 may be the longest, and the length L3 of the second coupling portion 150 may be substantially equal to the length L2 of the first coupling portion 140. Furthermore, the vertical projection of the first radiation element 111 may at least partially overlap the first coupling portion 140 of the floating metal element 120, and the vertical projection of the second radiation element 112 may at least partially overlap the second coupling portion 150 of the floating metal element 120. Generally, the length L1 of the main portion 130 is used to determine the resonant frequency of the antenna structure 100. The length L2 of the first coupling portion 140 and the length L3 of the second coupling portion 150 may be configured to determine the coupling amount between the floating metal element 120 and the dipole antenna element 110.

In some embodiments, the antenna structure 100 further includes a dielectric substrate 160, and the dipole antenna element 110 and the floating metal element 120 are respectively disposed on different layers of the dielectric substrate 160. For example, if the dielectric substrate 160 is a six-layer PCB (Printed Circuit Board), the first radiation element 111 may be disposed on a first layer E1 (i.e., the top layer) of the dielectric substrate 160, the second radiation element 112 may be disposed on a fourth layer E4 (i.e., positioned between the top layer and the bottom layer) of the dielectric substrate 160, and the floating metal element 120 may be disposed on a sixth layer E6 (i.e., the bottom layer) of the dielectric substrate 160, but they are not limited thereto. In other embodiments, the total number of layers of the dielectric substrate 160 may be adjusted to meet different requirements.

In some embodiments, the antenna structure 100 further includes a ground plane 170, which is made of a metal material and is disposed on the dielectric substrate 160. For example, if the dielectric substrate 160 is a six-layer PCB, the ground plane 170 may be distributed over the first layer E1 to the sixth layer E6 of the dielectric substrate 160. The ground plane 170 has a clearance region 175, which may substantially have a rectangular notch. The vertical projection of the dipole antenna element 110 and the vertical projection of the floating metal element 120 may both be completely inside the clearance region 175 of the ground plane 170. According to practical measurements, the incorporation of the floating metal element 120 can prevent the metal portions of the ground plane 170 from interfering with the dipole antenna element 110. It should be understood that the dielectric substrate 160 and the ground plane 170 are optional elements of the antenna structure 100, and they may be omitted or removed in other embodiments.

Figure 1C:
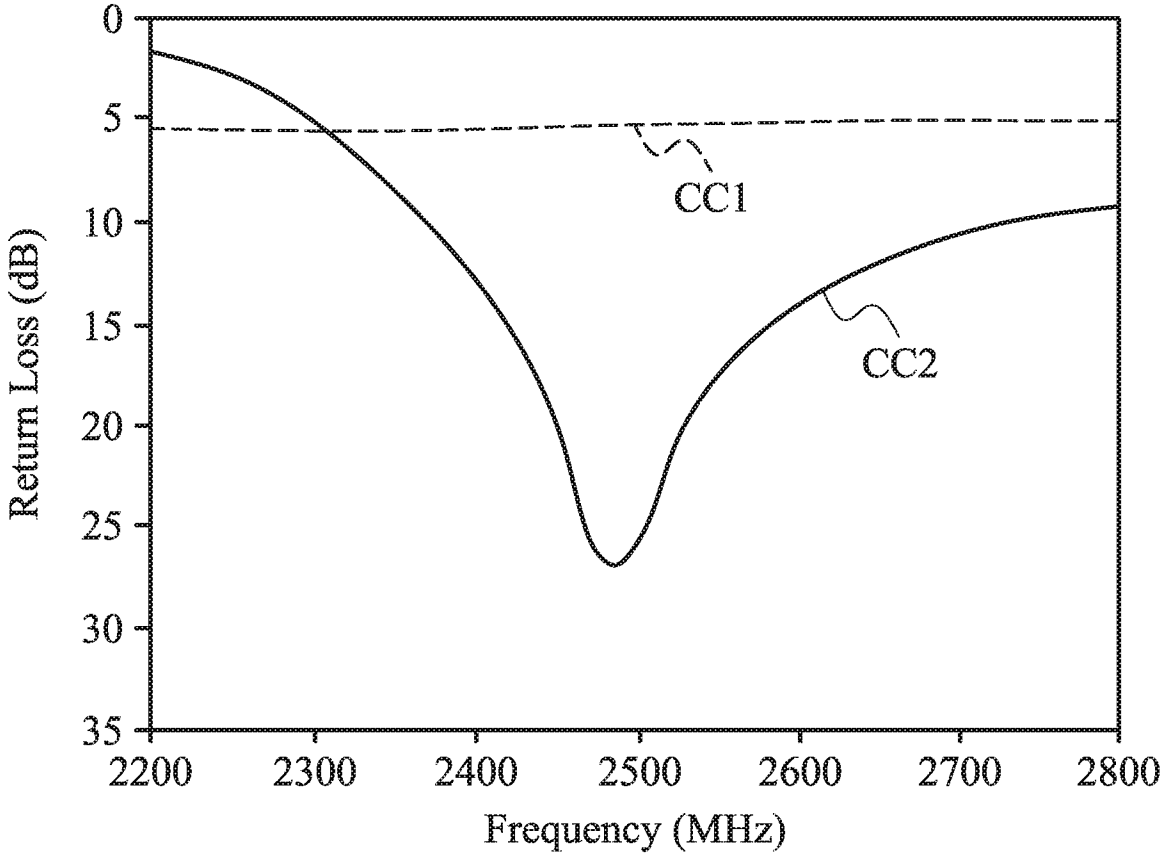
FIG. 1C is a diagram of return loss of an antenna structure according to an embodiment of the invention.

FIG. 1C is a diagram of return loss of the antenna structure 100 according to an embodiment of the invention. A first curve CC1 represents the operation characteristics of the antenna structure 100 without the floating metal element 120. A second curve CC2 represents the operation characteristics of the antenna structure 100 with the floating metal element 120. According to the measurement of FIG. 1C, the incorporation of the floating metal element 120 can significantly improve the bandwidth of the antenna structure 100, and therefore the antenna structure 100 can cover at least an operation frequency band from 2400 MHz to 2500 MHz. With such a design, the antenna structure 100 can support at least the wideband operations of Bluetooth and WLAN (Wireless Local Area Networks).

Figure 1D:
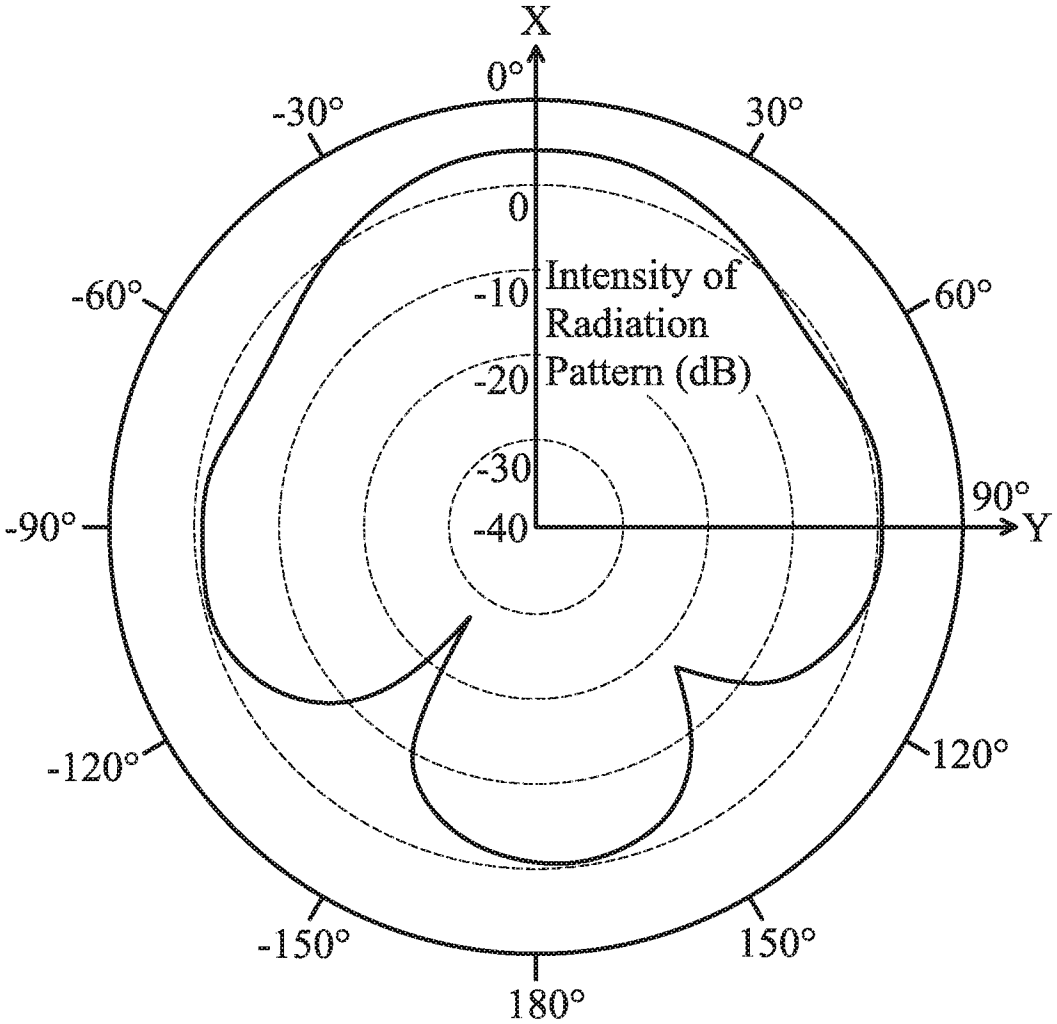
FIG. 1D is a radiation pattern of an antenna structure according to an embodiment of the invention.

FIG. 1D is a radiation pattern of the antenna structure 100 according to an embodiment of the invention. According to the measurement of FIG. 1D, the antenna structure 100 can provide an almost symmetrical radiation pattern on the XY plane, and the main beam direction of the antenna structure 100 can be substantially aligned with the opening direction (i.e., the direction of the +X-axis) of the U-shape of the floating metal element 120. It should be noted that if a conventional inverted-F-shaped antenna were used instead, the radiation pattern of the conventional inverted-F-shaped antenna would be asymmetrical, and the main beam direction of the conventional inverted-F-shaped antenna would shift toward one side (i.e., the direction of the +Y-axis). Accordingly, the incorporation of the proposed floating metal element 120 can fine-tune the radiation pattern of the antenna structure 100, so as to meet a variety of application requirements.

In some embodiments, the element sizes of the antenna structure 100 are described as follows. The length LA of the first radiation element 111 of the dipole antenna element 110 may be substantially equal to ¼ wavelength of the operation frequency band of the antenna structure 100 (the aforementioned wavelength is defined and measured in dielectric substrate 160). The length LB of the second radiation element 112 of the dipole antenna element 110 may be substantially equal to ¼ wavelength of the operation frequency band of the antenna structure 100 (the aforementioned wavelength is defined and measured in dielectric substrate 160). The distance D1 between the main portion 130 of the floating metal element 120 and the vertical projection of the dipole antenna element 110 may be longer than or equal to 1/40 wavelength of the operation frequency band of the antenna structure 100 (the aforementioned wavelength is defined and measured in the air). The distance D1 between the main portion 130 of the floating metal element 120 and the vertical projection of the dipole antenna element 110 may be shorter than or equal to 1/24 wavelength of the operation frequency band of the antenna structure 100 (the aforementioned wavelength is defined and measured in the air). The length L1 of the main portion 130 of the floating metal element 120 may be from 9/40 wavelength to 4/15 wavelength of the operation frequency band of the antenna structure 100 (the aforementioned wavelength is defined and measured in the air). The length L1 may be twice the length LA/LB. The length L2 of the first coupling portion 140 of the floating metal element 120 may be longer than 1/30 wavelength of the operation frequency band of the antenna structure 100 (the aforementioned wavelength is defined and measured in the air). For example, the length L2 of the first coupling portion 140 may be from 1/24 wavelength to 3/40 wavelength of the operation frequency band of the antenna structure 100. The length L3 of the second coupling portion 150 of the floating metal element 120 may be longer than 1/30 wavelength of the operation frequency band of the antenna structure 100 (the aforementioned wavelength is defined and measured in the air). For example, the length L3 of the second coupling portion 150 may be from 1/24 wavelength to 3/40 wavelength of the operation frequency band of the antenna structure 100. The floating metal element 120 may be an equal-width structure, whose width W1 may be from 0.1 mm to 2 mm. The distance D2 between the dipole antenna element 110 (or the second radiation element 112) and the floating metal element 120 may be longer than or equal to 0.2 mm. The distance D2 between the dipole antenna element 110 and the floating metal element 120 may be shorter than or equal to the thickness H1 (e.g., 1.1 mm) of the dielectric substrate 160. The length of the clearance region 175 of the ground plane 170 may be at least 30 mm. The width of the clearance region 175 of the ground plane 170 may be at least 10 mm. The above ranges of element sizes are calculated and obtained according to many experiment results, and they help to optimize the operation bandwidth and impedance matching of the antenna structure 100.

Figure 2A:
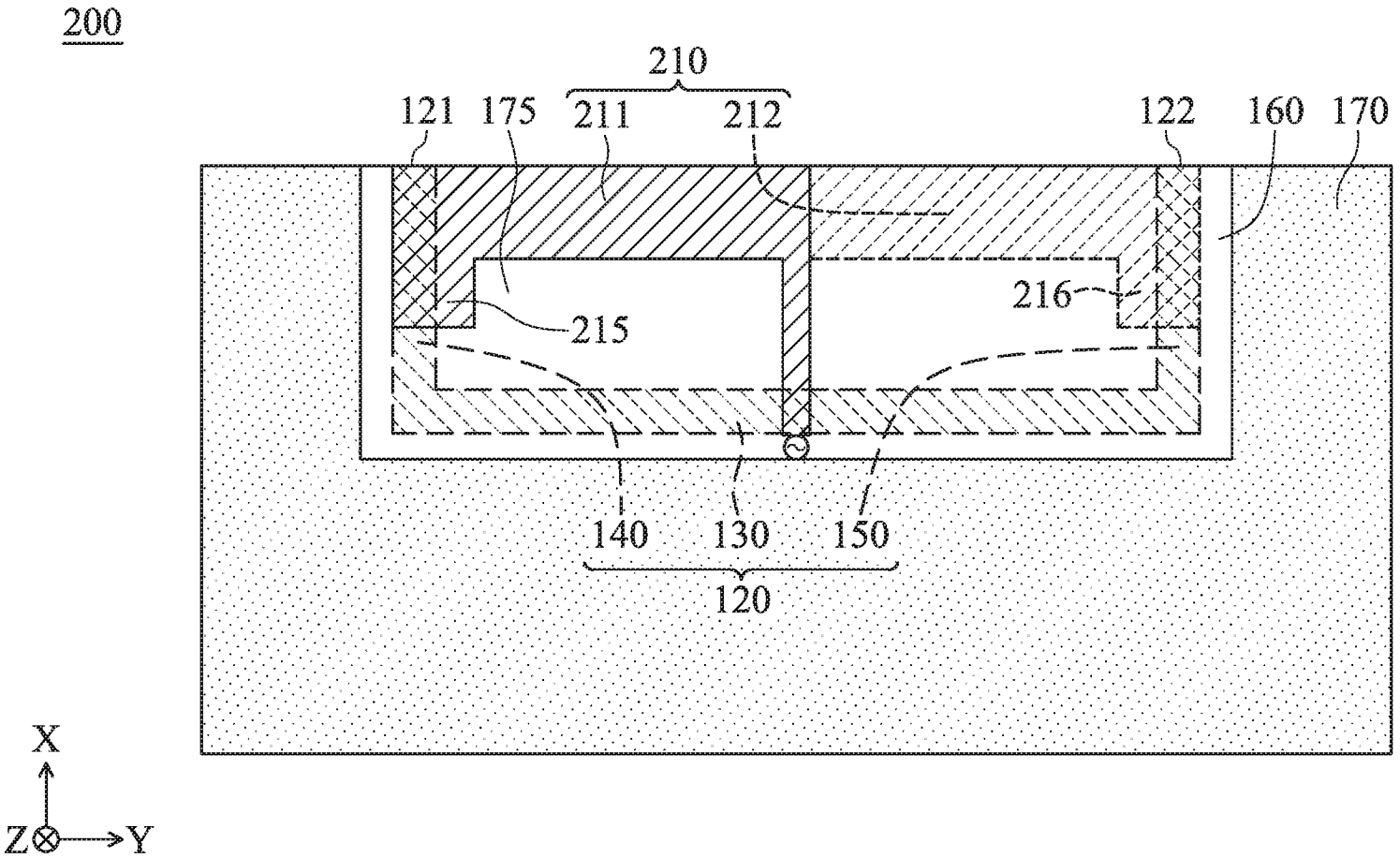
FIG. 2A is a top view of an antenna structure according to an embodiment of the invention.
Figure 2B:
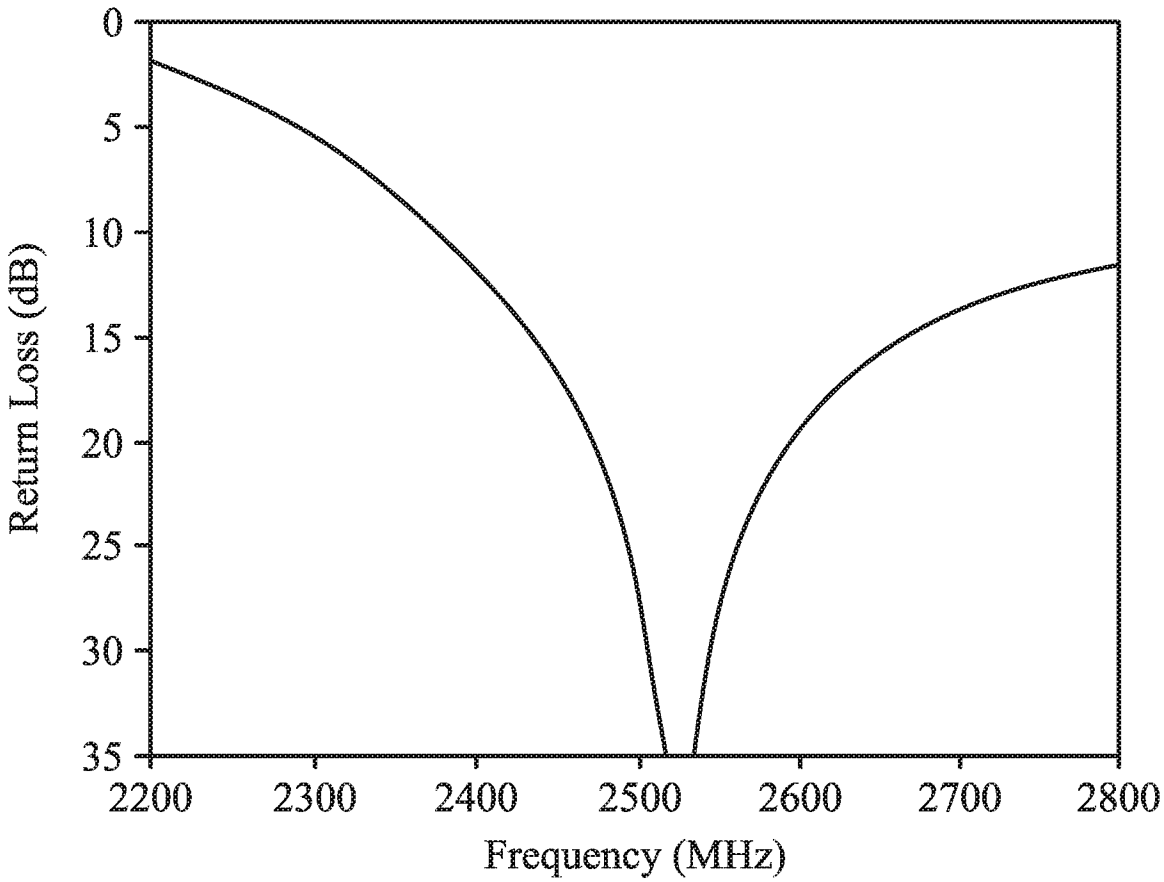
FIG. 2B is a diagram of return loss of an antenna structure according to an embodiment of the invention.

FIG. 2A is a top view of an antenna structure 200 according to an embodiment of the invention. FIG. 2A is similar to FIG. 1A. In the embodiment of FIG. 2A, a dipole antenna element 210 of the antenna structure 200 includes a first radiation element 211 and a second radiation element 212. The first radiation element 211 further includes a first terminal bending portion 215. The second radiation element 212 further includes a second terminal bending portion 216. Thus, each of the first radiation element 211 and the second radiation element 212 may substantially have an L-shape. The vertical projection of the first terminal bending portion 215 at least partially overlaps the first coupling portion 140 of the floating metal element 120. The vertical projection of the second terminal bending portion 216 at least partially overlaps the second coupling portion 150 of the floating metal element 120. Such a design can enhance the coupling effect between the dipole antenna element 210 and the floating metal element 120. FIG. 2B is a diagram of return loss of the antenna structure 200 according to an embodiment of the invention. According to the measurement of FIG. 2B, the incorporation of the first terminal bending portion 215 and the second terminal bending portion 216 can help to increase the operation bandwidth of the antenna structure 200 (i.e., from the original 320 MHz to 400 MHz or wider). Other features of the antenna structure 200 of FIG. 2A are similar to those of the antenna structure 100 of FIG. 1A and FIG. 1B. Therefore, the two embodiments can achieve similar levels of performance.

Figure 3:
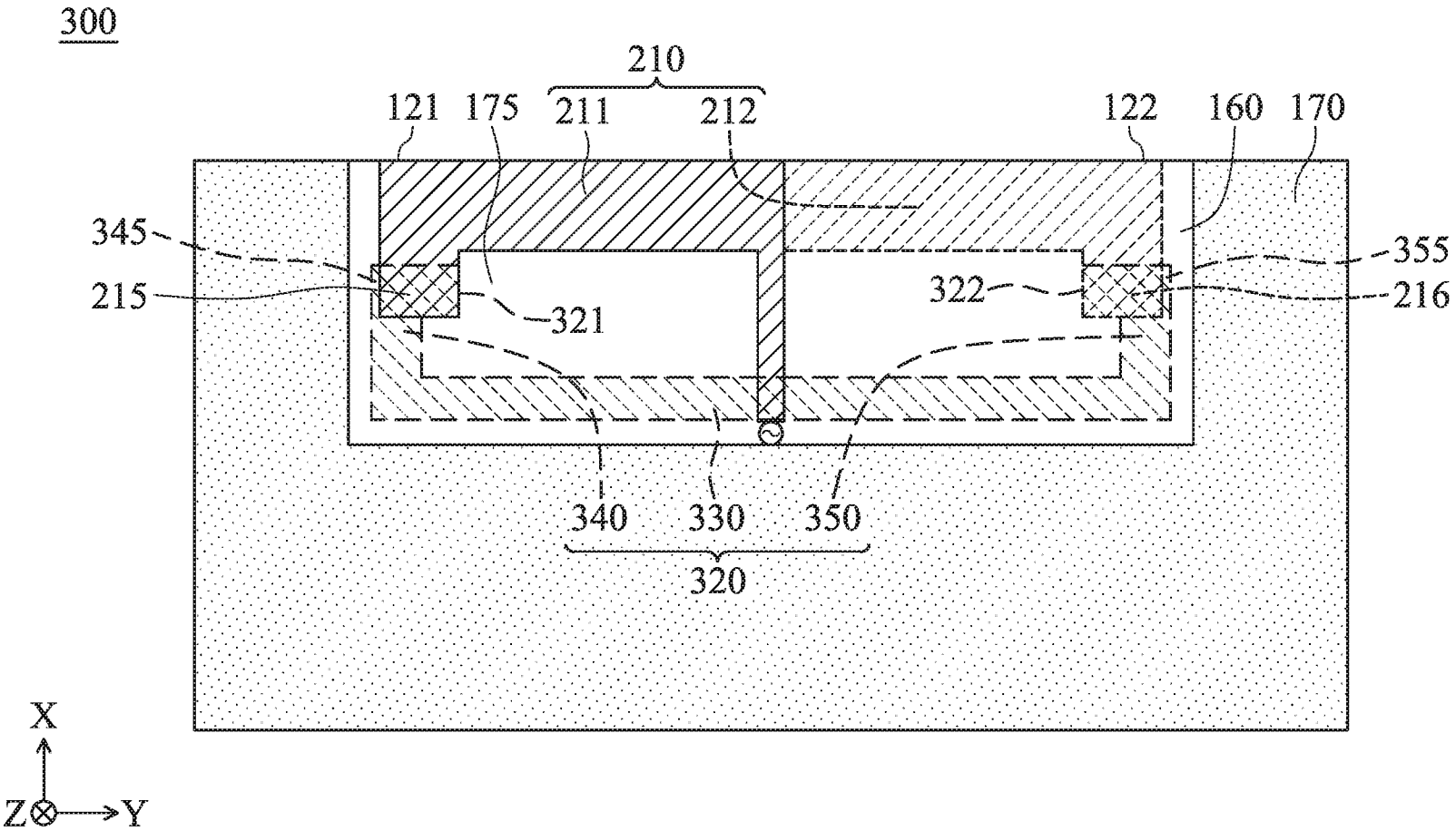
FIG. 3 is a top view of an antenna structure according to an embodiment of the invention.

FIG. 3 is a top view of an antenna structure 300 according to an embodiment of the invention. FIG. 3 is similar to FIG. 2A. In the embodiment of FIG. 3, a floating metal element 320 of the antenna structure 300 has a variable-width structure, which includes a main portion 330, a first coupling portion 340, a first terminal widening portion 345, a second coupling portion 350, and a second terminal widening portion 355. The first terminal widening portion 345 may substantially have a rectangular shape or a square shape. The first terminal widening portion 345 is coupled to the first coupling portion 340 and is positioned at a first end 321 of the floating metal element 320. The vertical projection of the first terminal bending portion 215 of the first radiation element 211 may at least partially overlap the first terminal widening portion 345. The second terminal widening portion 355 may substantially have a rectangular shape or a square shape. The second terminal widening portion 355 is coupled to the second coupling portion 350 and is positioned at a second end 322 of the floating metal element 320. The vertical projection of the second terminal bending portion 216 of the second radiation element 212 may at least partially overlap the second terminal widening portion 355. According to practical measurements, such a design can further enhance the coupling effect between the dipole antenna element 210 and the floating metal element 320 and further increase the operation bandwidth of the antenna structure 300. Other features of the antenna structure 300 of FIG. 3 are similar to those of the antenna structure 200 of FIG. 2A. Therefore, the two embodiments can achieve similar levels of performance.

Figure 4:
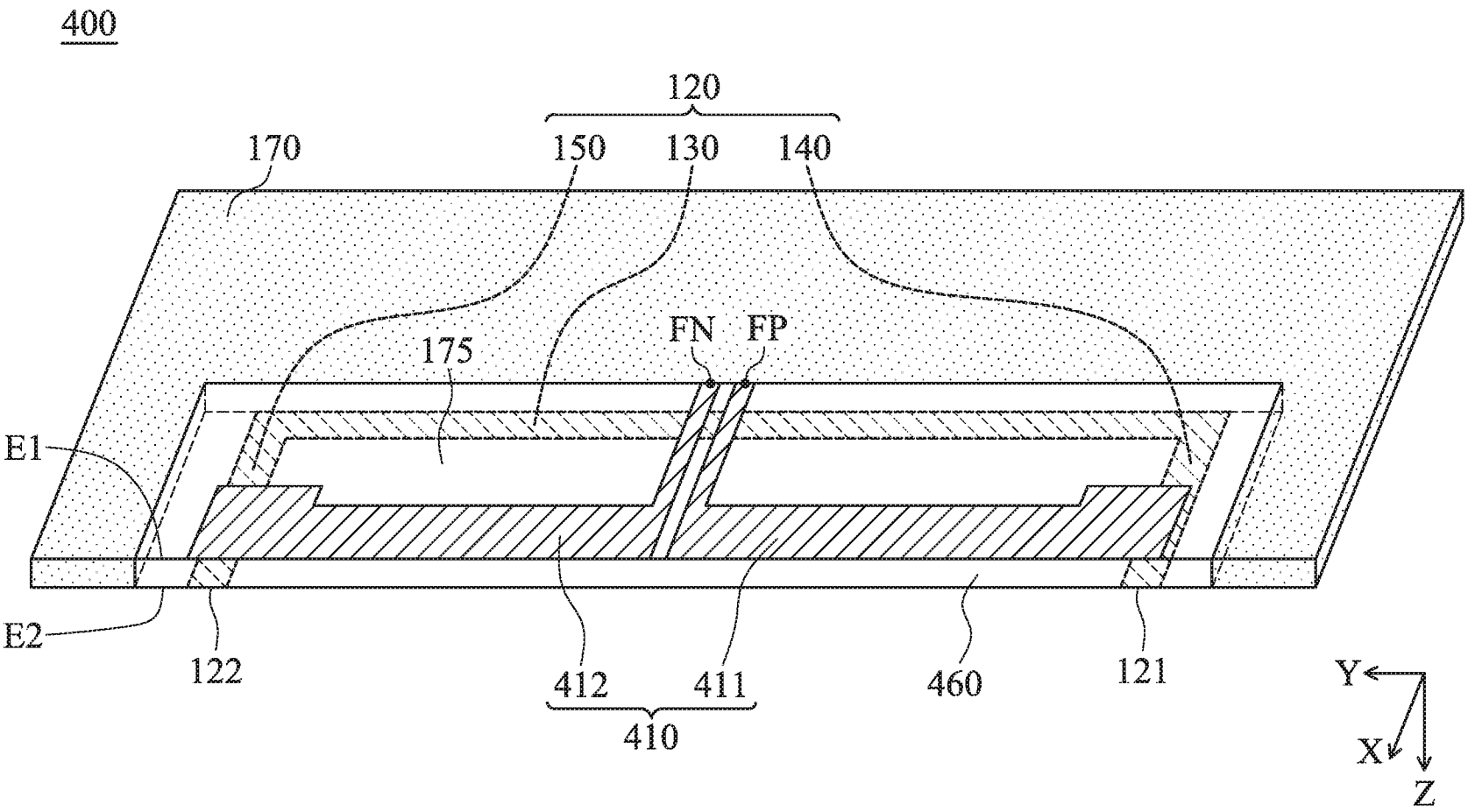
FIG. 4 is a perspective view of an antenna structure according to an embodiment of the invention.

FIG. 4 is a perspective view of an antenna structure 400 according to an embodiment of the invention. FIG. 4 is similar to FIG. 1B. In the embodiment of FIG. 4, a dipole antenna element 410 of the antenna structure 400 is a coplanar antenna. That is, the dipole antenna element 410 includes a first radiation element 411 and a second radiation element 412, and the first radiation element 411 and the second radiation element 412 are positioned on the same plane. If a dielectric substrate 460 of the antenna structure 400 is a two-layer PCB, both of the first radiation element 411 and the second radiation element 412 may be disposed on a first layer E1 (i.e., the top layer) of the dielectric substrate 460, and the floating metal element 120 may be disposed on a second layer E2 (i.e., the bottom layer) of the dielectric substrate 460, but they are not limited thereto. According to practical measurements, such a design can minimize the total size of the antenna structure 400, but does not negatively affect the radiation pattern and the operation bandwidth of the antenna structure 400. Other features of the antenna structure 400 of FIG. 4 are similar to those of the antenna structure 100 of FIG. 1A and FIG. 1B. Therefore, the two embodiments can achieve similar levels of performance.

Figure 5:
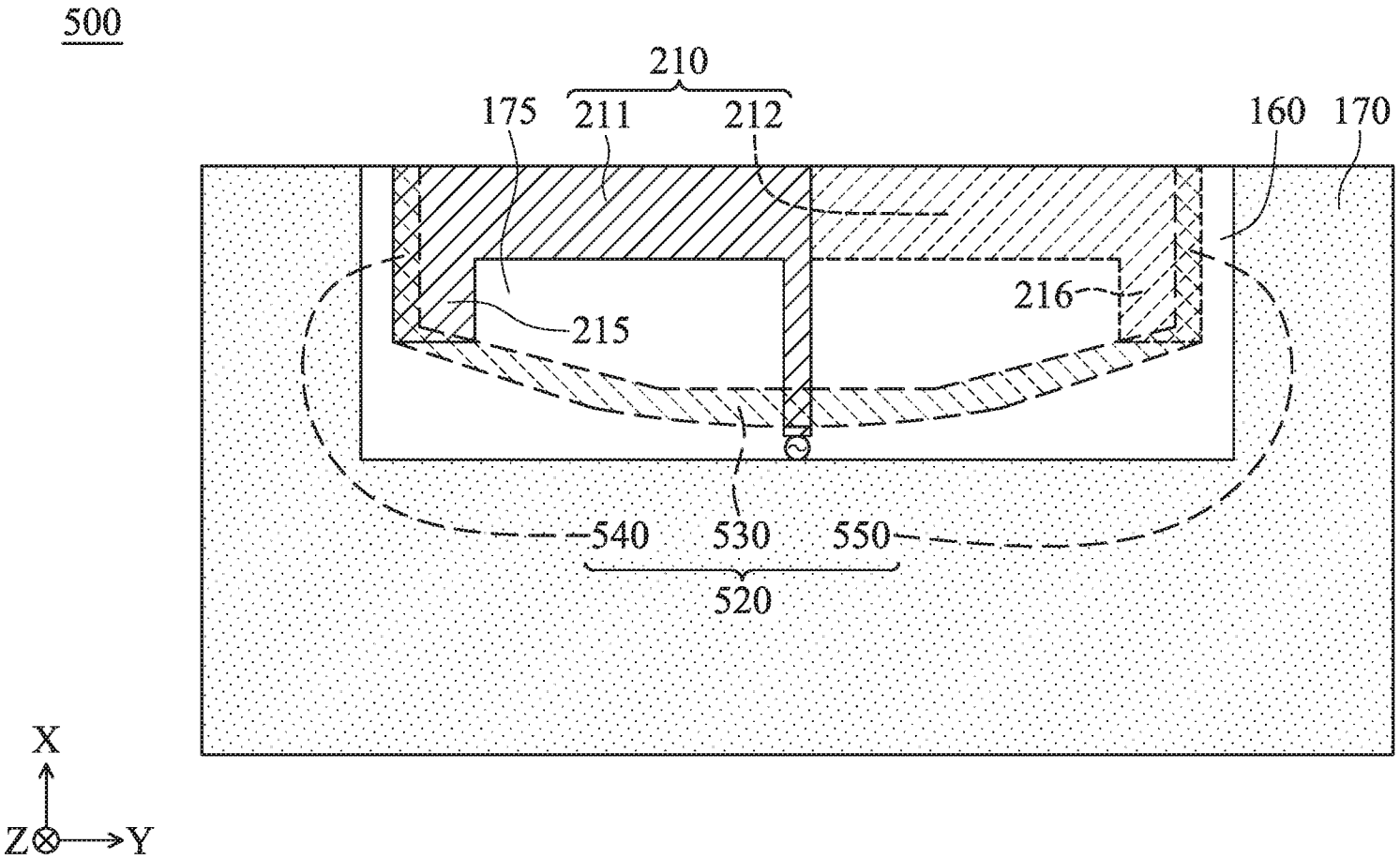
FIG. 5 is a top view of an antenna structure according to an embodiment of the invention.

FIG. 5 is a top view of an antenna structure 500 according to an embodiment of the invention. FIG. 5 is similar to FIG. 2A. In the embodiment of FIG. 5, a floating metal element 520 of the antenna structure 500 includes a main portion 530, a first coupling portion 540, and a second coupling portion 550. The main portion 530 may substantially have a relatively short arc-shape (in comparison to FIG. 6). Each of the first coupling portion 540 and the second coupling portion 550 may substantially have a straight-line shape. For example, the length of the main portion 530 may be substantially equal to 9/40 wavelength of the operation frequency band of the antenna structure 500. Other features of the antenna structure 500 of FIG. 5 are similar to those of the antenna structure 200 of FIG. 2A. Therefore, the two embodiments can achieve similar levels of performance.

Figure 6:
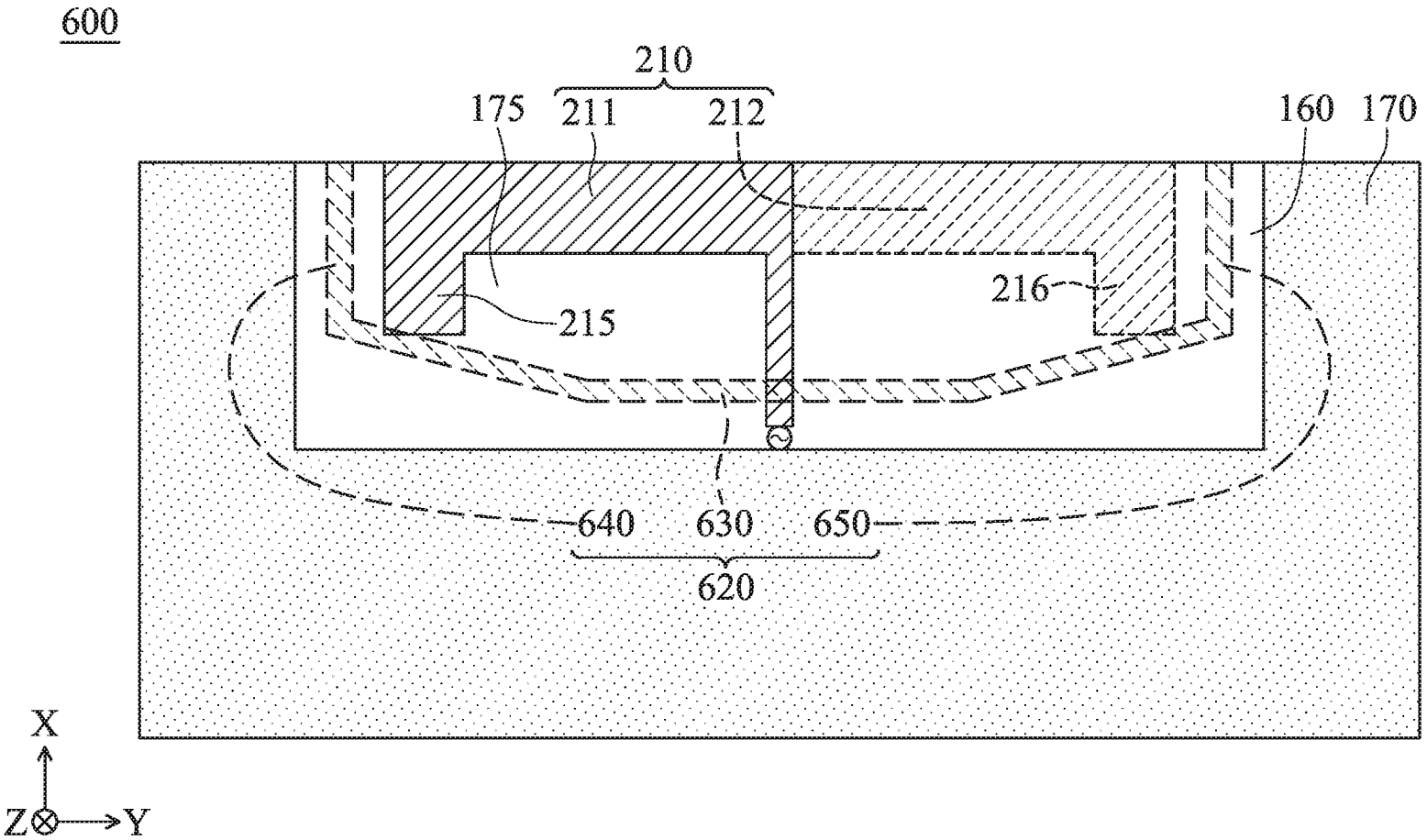
FIG. 6 is a top view of an antenna structure according to an embodiment of the invention.

FIG. 6 is a top view of an antenna structure 600 according to an embodiment of the invention. FIG. 6 is similar to FIG. 2A. In the embodiment of FIG. 6, a floating metal element 620 of the antenna structure 600 includes a main portion 630, a first coupling portion 640, and a second coupling portion 650. The main portion 630 may substantially have a relatively long arc-shape (in comparison to FIG. 5). Each of the first coupling portion 640 and the second coupling portion 650 may substantially have a straight-line shape. For example, the length of the main portion 630 may be substantially equal to 4/15 wavelength of the operation frequency band of the antenna structure 600. Other features of the antenna structure 600 of FIG. 6 are similar to those of the antenna structure 200 of FIG. 2A. Therefore, the two embodiments can achieve similar levels of performance.

Figure 7:
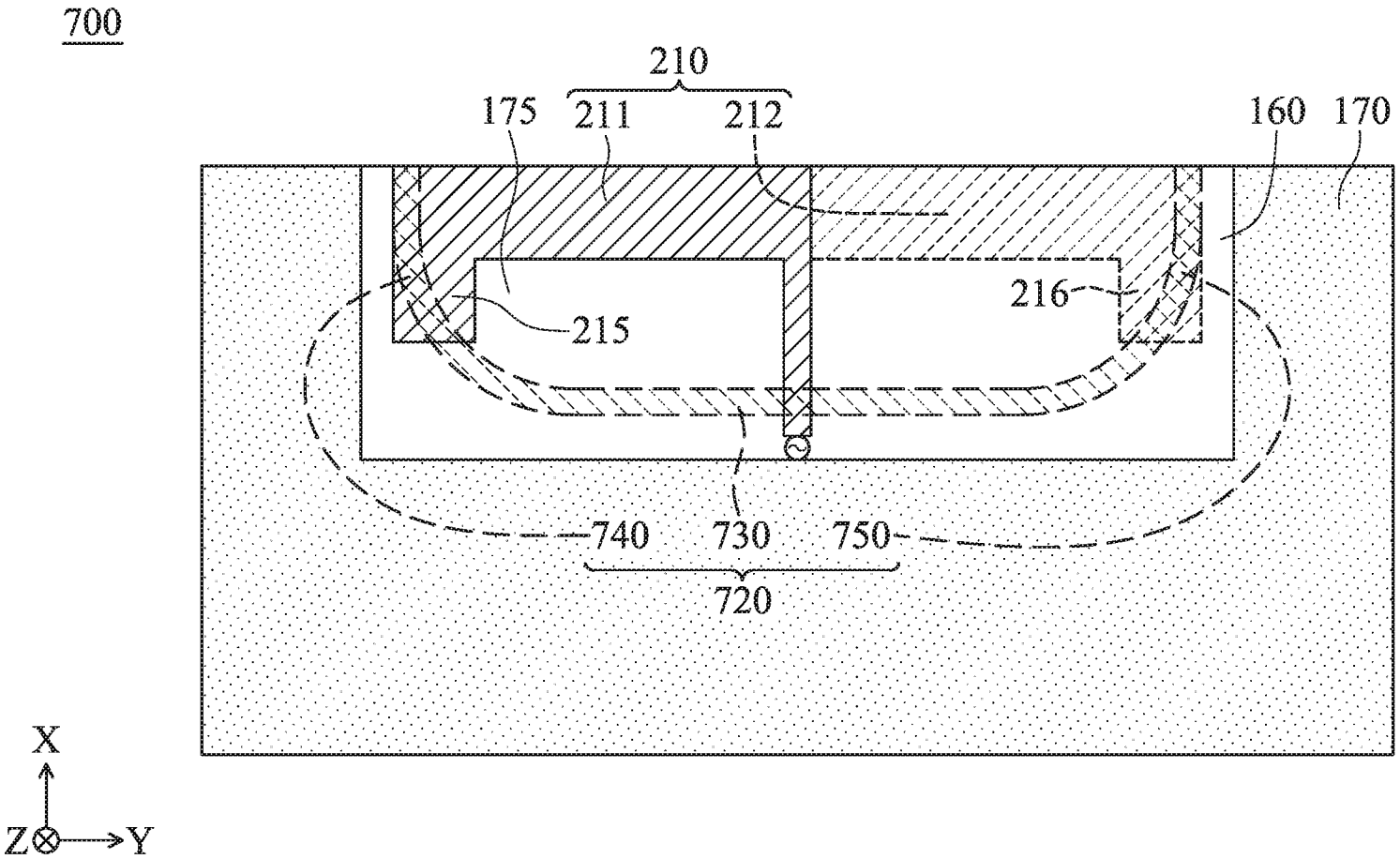
FIG. 7 is a top view of an antenna structure according to an embodiment of the invention.

FIG. 7 is a top view of an antenna structure 700 according to an embodiment of the invention. FIG. 7 is similar to FIG. 2A. In the embodiment of FIG. 7, a floating metal element 720 of the antenna structure 700 includes a main portion 730, a first coupling portion 740, and a second coupling portion 750. A combination of the main portion 730, the first coupling portion 740, and the second coupling portion 750 may substantially have a relatively smooth arc-shape (in comparison to FIG. 5 and FIG. 6). Other features of the antenna structure 700 of FIG. 7 are similar to those of the antenna structure 200 of FIG. 2A. Therefore, the two embodiments can achieve similar levels of performance.

The invention proposes a novel antenna structure. By using the proposed floating metal element, the invention can fine-tune the main beam direction of the dipole antenna element and increase the operation bandwidth of the dipole antenna element. In comparison to conventional designs, the invention has at least the advantages of small size, wide band, low complexity, high gain, and low manufacturing cost, and therefore it is suitable for application in a variety of communication devices.

Note that the above element sizes, element shapes, and frequency ranges are not limitations of the invention. An antenna designer can fine-tune these settings or values to meet different requirements. It should be understood that the antenna structure of the invention is not limited to the configurations of FIGS. 1-7. The invention may merely include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a dipole antenna element; and a floating metal element, disposed adjacent to the dipole antenna element, wherein a vertical projection of the dipole antenna element at least partially overlaps the floating metal element;

wherein the antenna structure at least covers an operation frequency band;

wherein the floating metal element comprises a main portion, a first coupling portion, and a second coupling portion, and wherein the main portion is coupled between the first coupling portion and the second coupling portion; and wherein a distance between the main portion of the floating metal element and the vertical projection of the dipole antenna element is longer than or equal to 1/40 wavelength of the operation frequency band.

2. The antenna structure as claimed in claim 1, wherein the operation frequency band is from 2400 MHz to 2500 MHz.

3. The antenna structure as claimed in claim 1, wherein the dipole antenna element comprises a first radiation element coupled to a positive feeding point, and a second radiation element coupled to a negative feeding point.

4. The antenna structure as claimed in claim 3, wherein the first radiation element and the second radiation element are disposed on the same plane.

5. The antenna structure as claimed in claim 3, wherein the first radiation element and the second radiation element are respectively disposed on different planes.

6. The antenna structure as claimed in claim 3, wherein the first radiation element further comprises a first terminal bending portion, and the second radiation element further comprises a second terminal bending portion.

7. The antenna structure as claimed in claim 3, wherein each of the first radiation element and the second radiation element substantially has a straight-line shape or an L-shape.

8. The antenna structure as claimed in claim 1, wherein the floating metal element substantially has a U-shape.

9. The antenna structure as claimed in claim 1, wherein the floating metal element substantially has an arc-shape.

10. The antenna structure as claimed in claim 1, wherein the floating metal element further comprises a first terminal widening portion coupled to the first coupling portion.

11. The antenna structure as claimed in claim 1, wherein the floating metal element further comprises a second terminal widening portion coupled to the second coupling portion.

12. The antenna structure as claimed in claim 1, wherein a distance between the main portion of the floating metal element and the vertical projection of the dipole antenna element is shorter than or equal to 1/24 wavelength of the operation frequency band.

13. The antenna structure as claimed in claim 1, wherein a length of the main portion of the floating metal element is from 9/40 wavelength to 4/15 wavelength of the operation frequency band.

14. The antenna structure as claimed in claim 1, wherein a length of each of the first coupling portion and the second coupling portion of the floating metal element is longer than 1/30 wavelength of the operation frequency band.

15. The antenna structure as claimed in claim 1, wherein a distance between the dipole antenna element and the floating metal element is longer than or equal to 0.2 mm.

16. The antenna structure as claimed in claim 1, further comprising:

a dielectric substrate, wherein the dipole antenna element and the floating metal element are respectively disposed on different planes of the dielectric substrate.

17. The antenna structure as claimed in claim 16, wherein the dielectric substrate is a two-layer PCB (Printed Circuit Board) or a six-layer PCB.

18. The antenna structure as claimed in claim 16, further comprising:

a ground plane, disposed on the dielectric substrate, and having a clearance region, wherein the vertical projection of the dipole antenna element and a vertical projection of the floating metal element are inside the clearance region.

* * * * *